US005160138A

United States Patent [19]

Sanders

[11] Patent Number: 5,160,138

[45] Date of Patent: Nov. 3, 1992

[54] ATHLETIC TRAINING DEVICE

[76] Inventor: Thomas E. Sanders, 94 Red Fox Rd., Stamford, Conn. 06903

[21] Appl. No.: 708,691

[22] Filed: May 31, 1991

[51] Int. Cl.[5] ..... A63B 69/00

[52] U.S. Cl. ..... 273/1.5 A; 273/55 R; 273/57.2

[58] Field of Search ..... 273/1.5 A, 55 R, 411, 273/57.2

[56] References Cited

U.S. PATENT DOCUMENTS

| | | | |
|---|---|---|---|
| 1,739,795 | 12/1929 | Krasheninnikoff | 273/57.3 |
| 3,062,547 | 11/1962 | Kopp | 273/55 R |
| 3,552,749 | 1/1971 | Piggotte | 273/1.5 A |
| 3,675,921 | 7/1972 | Meyers, Sr. | 273/1.5 A |
| 3,804,406 | 4/1974 | Viscione | 272/76 |
| 3,868,108 | 2/1975 | Kirchner | 273/1.5 A |
| 4,319,748 | 3/1982 | Alter | 272/93 |
| 4,538,808 | 9/1985 | Holland | 273/1.5 A |
| 4,699,386 | 10/1987 | Carzino | 273/57.2 X |

FOREIGN PATENT DOCUMENTS

| | | | |
|---|---|---|---|
| 1535552 | 1/1990 | U.S.S.R. | 273/1.5 R |

*Primary Examiner*—Paul E. Shapiro

*Attorney, Agent, or Firm*—Ostrolenk, Faber, Gerb & Soffen

[57] ABSTRACT

A training device which is capable of following the lateral movements of an athlete, such as a basketball player, and blocking the player's shots while the player is trying to shoot or pass. The device includes a carriage with at least one wheel. A projection extends from the carriage and terminates in a blocking screen. The carriage is attached at one side to an extension pole which is attached to the backboard support pole. The other side of the carriage is attached to the player by a cord, preferably elastic. When the player moves, the carriage follows the player's lateral movements and blocks the player's attempts to shoot or pass the basketball.

16 Claims, 9 Drawing Sheets

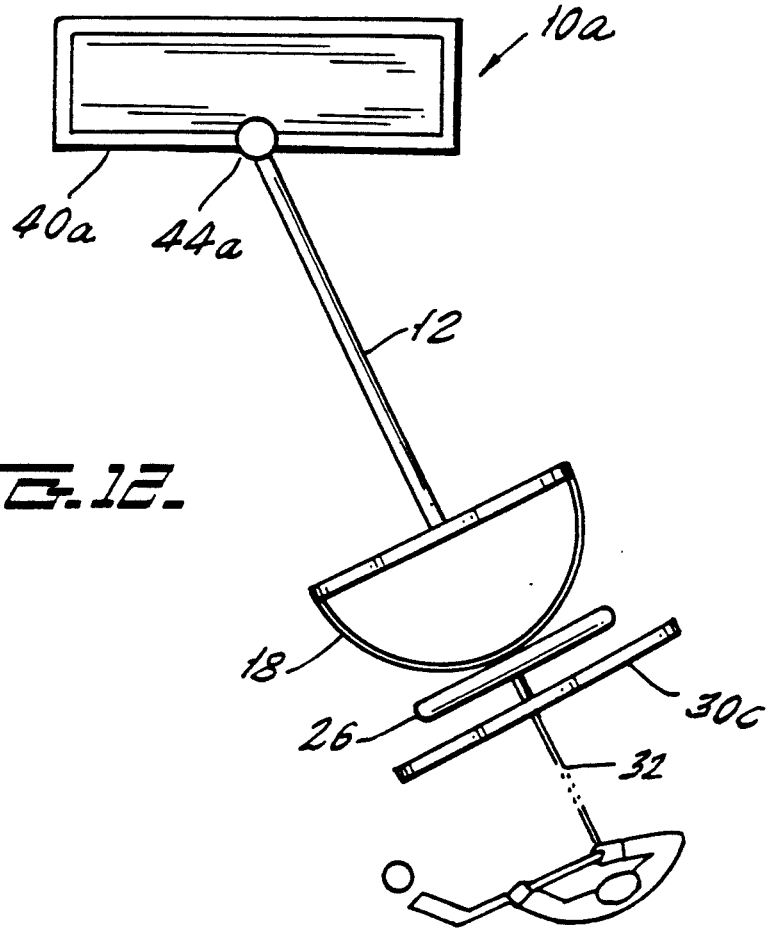
FIG. 12.
FIG. 7.
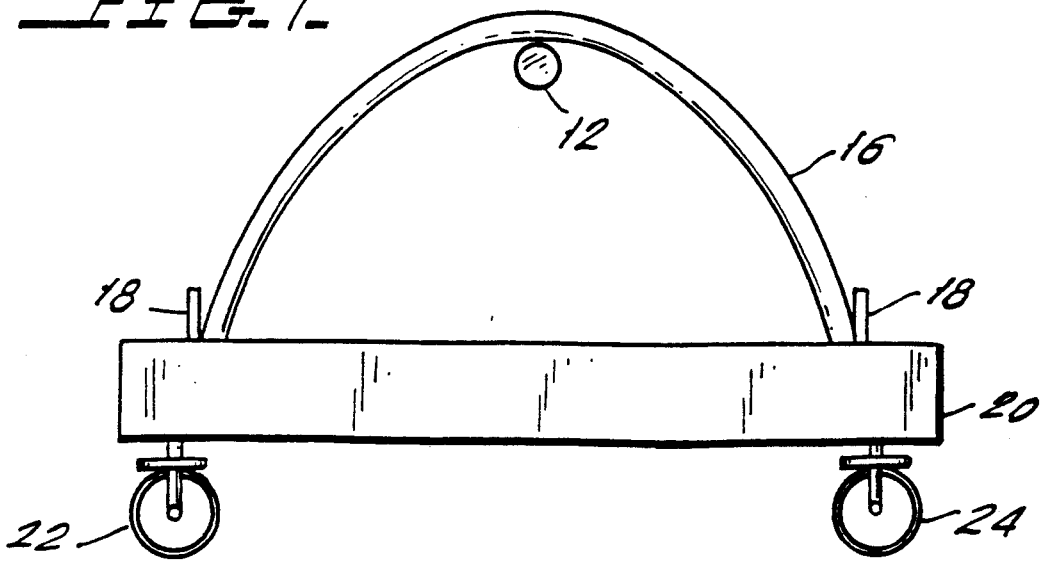

ATHLETIC TRAINING DEVICE

BACKGROUND OF THE INVENTION

The present invention relates to an athletic training device, and more particularly to a device that simulates the movements of a basketball player, for training basketball players to shoot or pass a basketball over a defender who is blocking the player's shots. The device is useful in other sports as well.

The prior art discloses several basketball training devices that can block or interfere with the jumping or shooting movements of a basketball player.

U.S. Pat. No. 3,552,749 discloses a shot-blocking device which comprises a life-size figure with four rotatably driven "arms" projecting outward from the figure which can be rotated in either direction.

U.S. Pat. No. 3,675,921 discloses a device which comprises a representation of an opposing player and a device which moves the representation up and down to simulate jumping.

U.S. Pat. No. 3,868,108 discloses a mechanical hand which is mounted to a headband to block a player's view while shooting.

U.S. Pat. No. 4,538,808 discloses a cage-like structure with arm members extending from the inside of the cage to obstruct a player's jumping and shooting movements.

None of the disclosed devices is capable of easily being moved laterally to follow a player who is moving around the basket. Instead, they are essentially stationary devices that can only be moved awkwardly. Nor do they have any means for keeping the device in a position between the player and the basket. Because of these drawbacks, the known devices have only limited usefulness for training a basketball player under realistic playing conditions.

SUMMARY OF THE INVENTION

It is therefore a primary object of this invention to provide a training device which is capable of following the lateral movements of a player who is trying to shoot or pass a basketball, football, hockey puck, or the like, and blocking the player's shots.

Another object is to provide means for keeping the device in a position between the player and a basket or other target.

A further object is to allow the player to practice at a range of positions on the court or field, with the device being easily movable from position to position.

These and other objects are achieved by the disclosed embodiments of a training device, which are capable of following the lateral movements of a basketball player, for example, and blocking the player's shots while the player is trying to shoot a basketball. The device may include a carriage with at least one wheel. A projection may extend from the carriage and hold a blocking screen. The carriage may be attached at one side to an extension pole which is attached to the backboard support pole. The other side of the carriage may be attached to the player by a cord, preferably elastic. When the player moves, the carriage follows the player s lateral movements and blocks the player's attempts to shoot or pass the basketball.

A broad aspect of the invention relates to an athletic training device for training a player to move a projectile from near the player to a target, comprising blocking means capable of blocking the projectile; and moving means for moving the blocking means toward a path between the player and the target, to force the player to avoid the blocking means while moving the projectile. The projectile may be a basketball or another type of game ball, or a hockey puck, or any other type of projectile.

According to one disclosed embodiment of the invention, a basketball training device comprises a mobile carriage; blocking means on the carriage located for blocking a player's basketball shots; means for attaching the carriage to a location associated with the target of the player's basketball shots; and means for attaching the carriage to a player so that when the player moves laterally, the device follows the player and tends to block the player's shots.

A particularly advantageous aspect of the invention is the use of an adjustable extension pole between the carriage and the backboard support pole to locate the device at a variable distance from the basket, thus allowing a player to use the device at any distance from the basket and anywhere on the court.

Other feature and advantages of the present invention will become apparent from the following description of an embodiment of the invention, with reference to the accompanying drawings.

BRIEF DESCRIPTION OF THE DRAWINGS

FIG. 7 is a fragmentary view illustrating the swiveling wheels and braces.

FIGS. 11 and 12 are respectively a perspective view and a plan view of another embodiment of the invention which is adapted for hockey training.

DESCRIPTION OF A PREFERRED EMBODIMENT OF THE INVENTION

Figure 1:
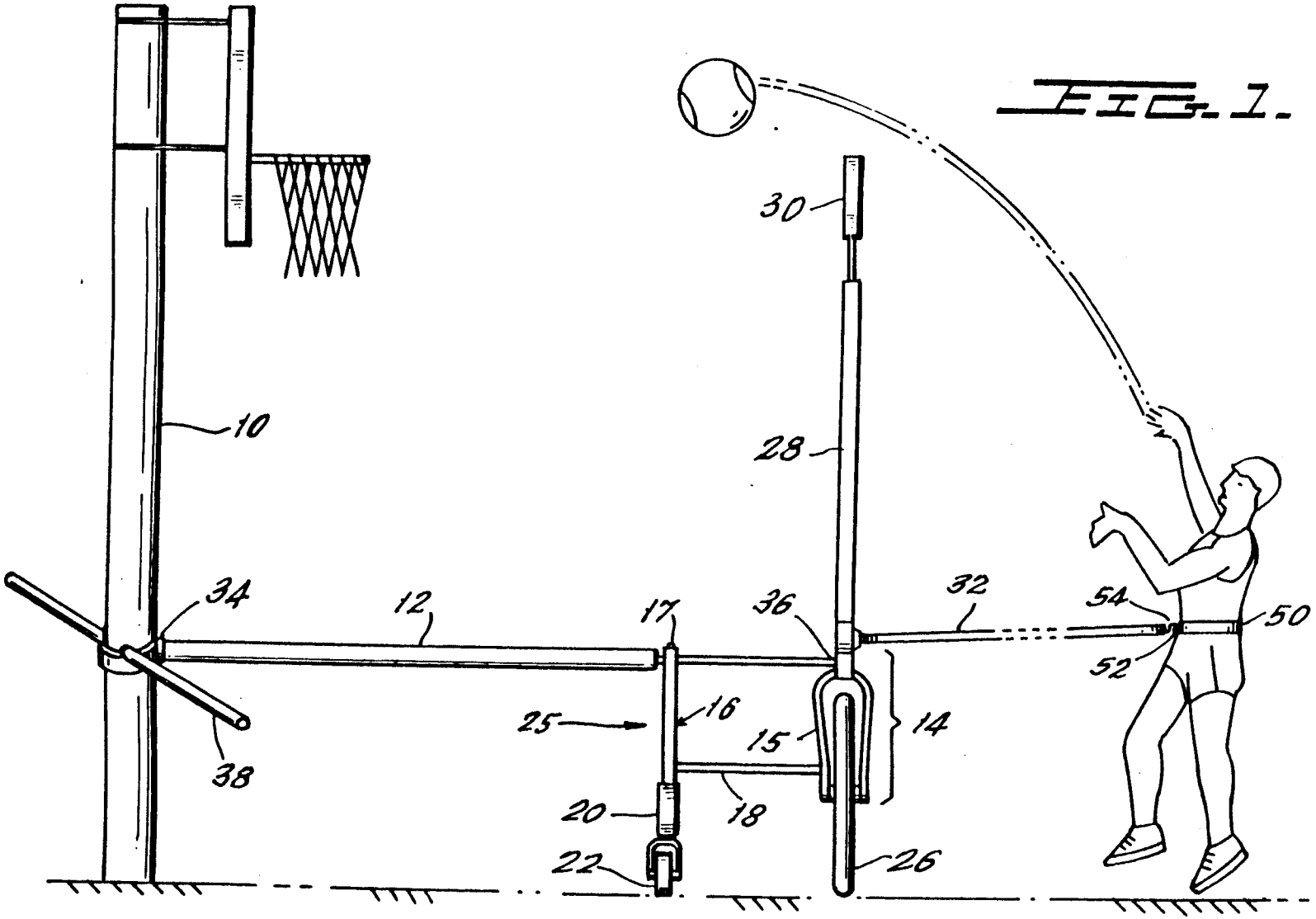
FIG. 1 is a perspective view of a basketball training device in accordance with an embodiment of the present invention and illustrating the use thereof by a basketball player..
Figure 2:
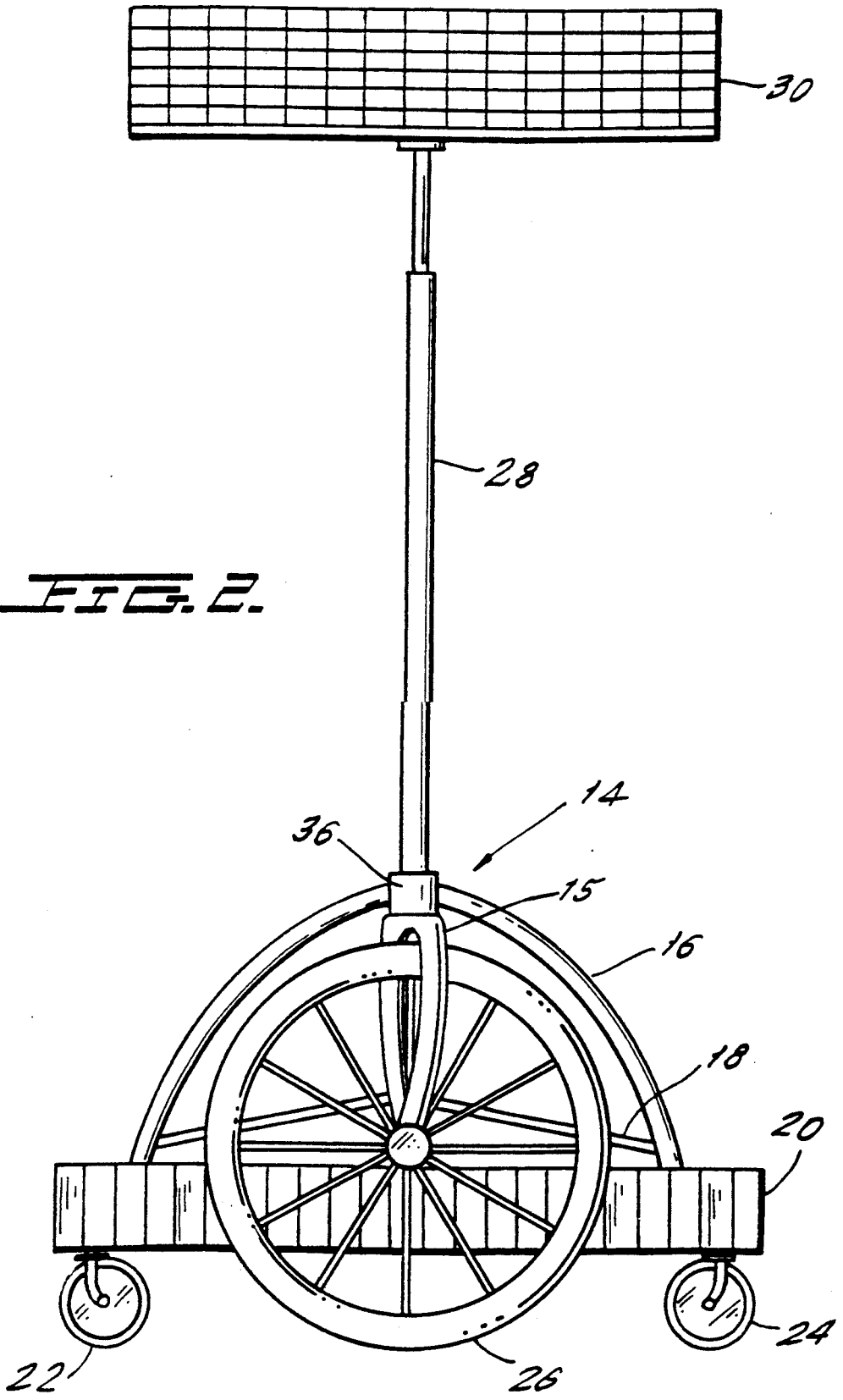
FIG. 2 is a front view of the device from the perspective of the player.
Figures 1A, 1B, 3:
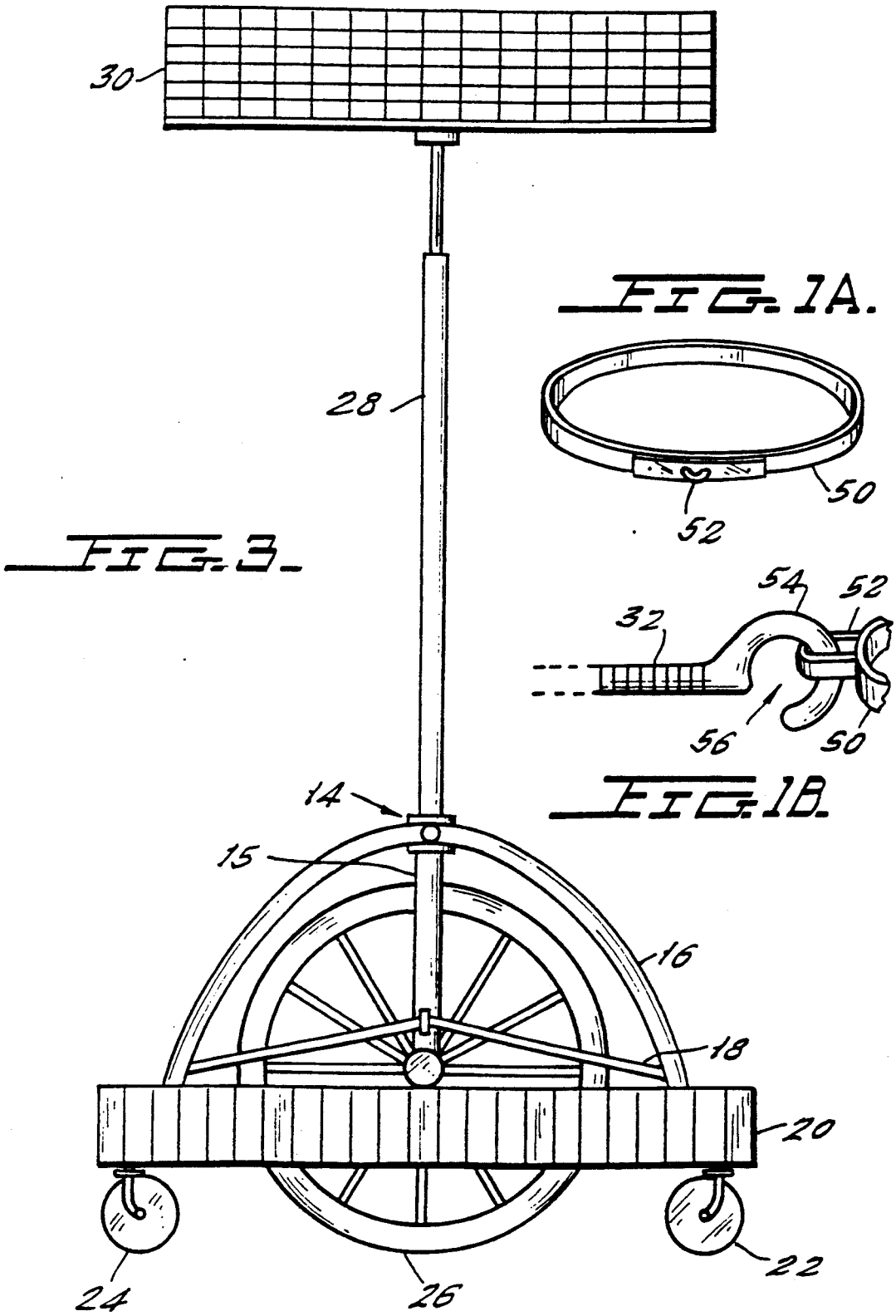
FIG. 1A is a perspective view of a belt which is usable with the training device.
FIG. 1B is a detail view showing a hook secured to the end of an elastic cord, the hook being attached to the belt of FIG. 1A.
FIG. 3 is a rear view of the device as seen in the direction facing the player.

FIGS. 1-8 show a first embodiment of a training device according to the invention, which is particularly adapted for use in basketball training. In the training device, a carriage 14 which can follow a player s movements provides the supporting framework for a mobile blocking device to block the player's shots and passes, as will be described further below. Referring first to FIGS. 1-3, the carriage 14 includes a fork 15 on which a large wheel 26 is mounted. Extending vertically upward from carriage 14 is an adjustable extension pole 28, which may be made of fiberglass. Pole 28 terminates in a screen 30 which may be 3 to 4 feet wide, and made of fiberglass, plywood, plastic, or another material, preferably lightweight. The screen may be extended or shaped to adapt it to particular types of blocking maneuvers.

The carriage 14 is attached to one end of a horizontal extension pole 12 which is attached at its other end to a backboard support pole 10. Of course, the extension pole 12 can be attached to any other reference point, which should be closely associated with the basket or another target (such as a pass-receiving player).

A cord 32, preferably elastic, about 4–7 feet long, is attached at one end to a player and at the other end to carriage 14. As the player moves around the court, the device is pulled by the player and follows the player, forcing the player to shoot over or around the screen 30. Because the cord 32 is elastic, there is a time lag between a player's movement and the arrival of the carriage 14 at the position of the player. Also, the wheel 26 is large, perhaps about 24" in diameter, and may weigh as much as 3–10 pounds, for example. Therefore, the carriage 14 and wheel 26 have substantial inertia which both contributes to the time lag mentioned above, and also causes the carriage 14 to overshoot the player's position somewhat. Thus, the behavior of the device is somewhat unpredictable, which enhances the realism of training with the device.

The extension pole 12 is adjustable in length and may be made of metal. In this embodiment of the invention, the pole 12 telescopes, but other adjustments may be provided. It is attached to the support pole 10 by a sleeve, strap or other convenient anchoring device 34.

Figure 4:
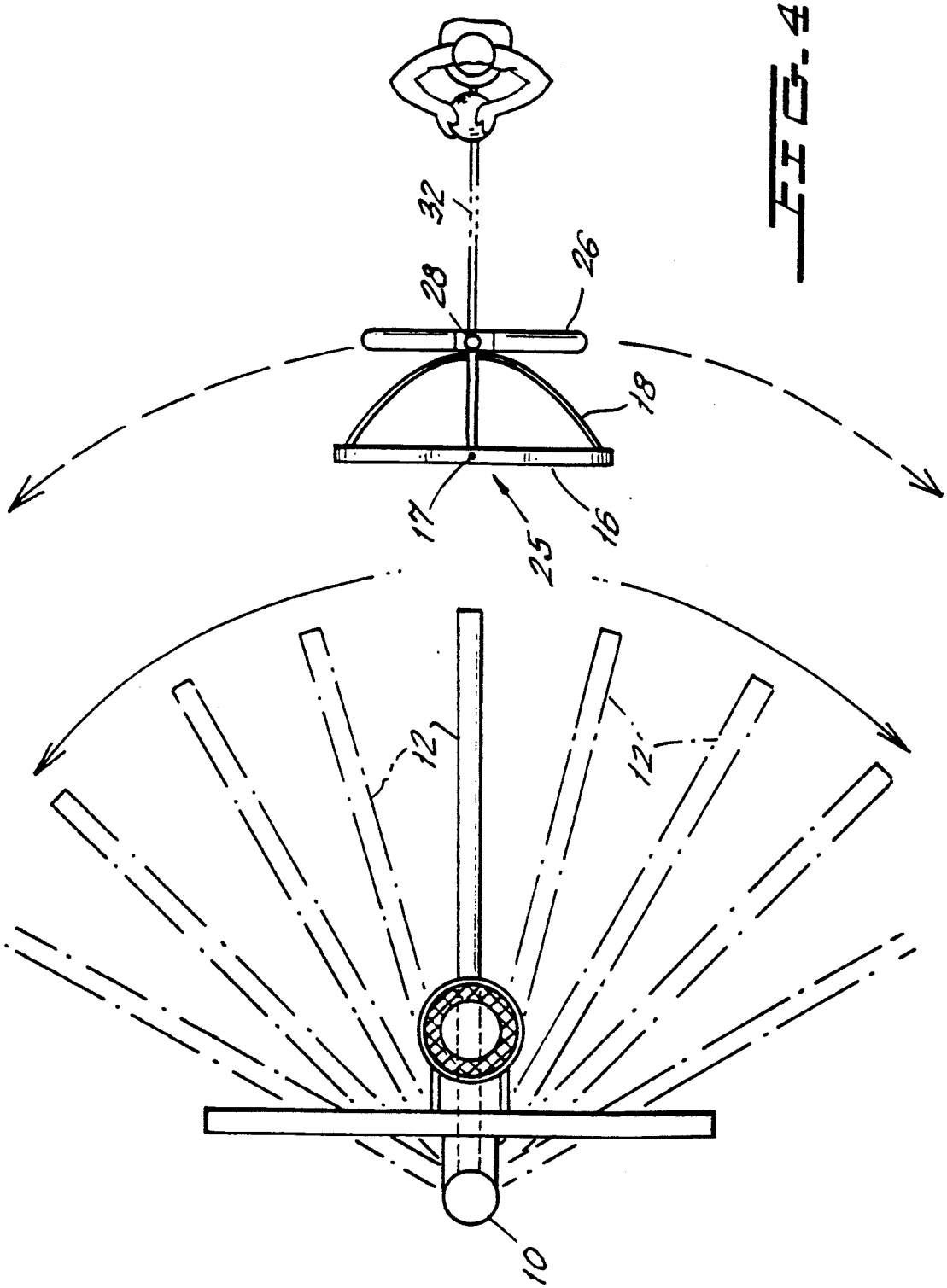
FIG. 4 is a top view of the device illustrating the range of movement of which the device is capable.

As shown in FIG. 4, the device is capable of a substantially semicircular motion when moved by the player attached to the device by cord 32. For closer shots extension pole 12 is adjusted to move the carriage 14 nearer to the support pole.

Advantageously, a rod or other obstruction 38 is provided on the backboard support pole to prevent the device from going behind the backboard. When pole 12 becomes parallel to the backboard, the rod 38 prevents the movement of pole 12 beyond this point.

Carriage 14 is attached (at 36) to the end of the pole 12 away from the backboard pole 10. Carriage 14 may be attached to pole 12 by a strap similar to anchoring device 34, or by any other convenient attachment.

Further support for the carriage 14 and extension pole 12 is provided by an outrigger 25, which in this embodiment includes two swivel wheels 22 and 24 attached to a panel 20, which may be made of wood, possibly 3 feet long, 6" wide and 1" thick. Board 20 is attached to extension pole 12 by a generally curved or V-shaped metal brace 16. Metal brace 16 is then attached to the carriage by another generally curved or V-shaped metal brace 18. The metal braces preferably behave like leaf springs and may be about 1½" wide by 4 feet in overall length.

Figure 6:
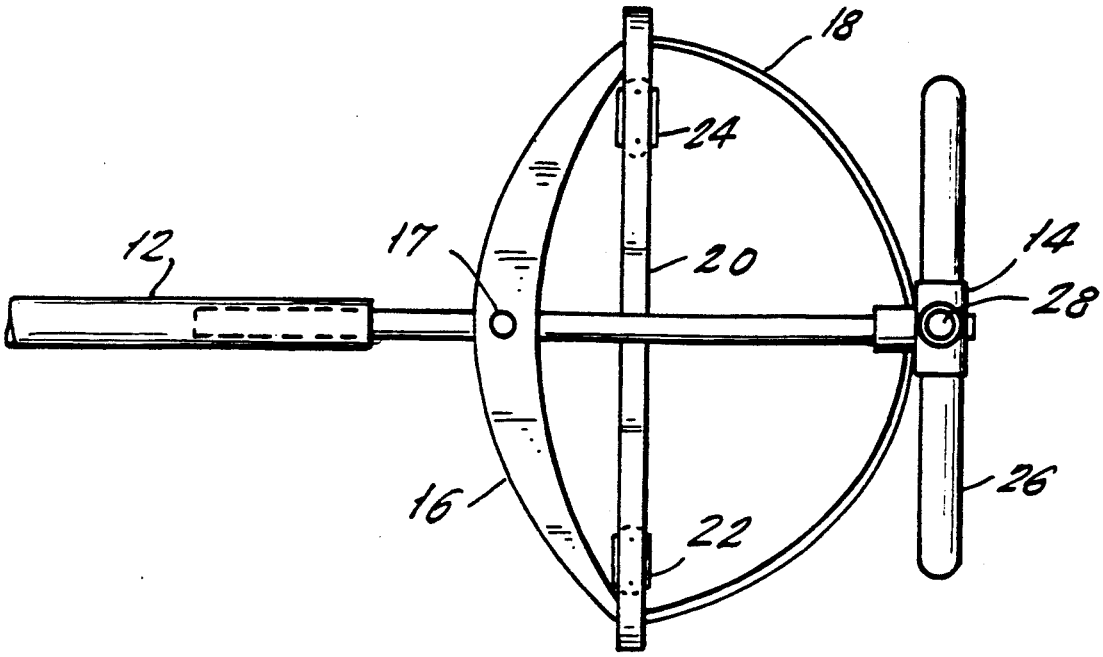
FIG. 6 is a fragmentary view illustrating the wheels, braces and carriage of the device.
Figure 5:
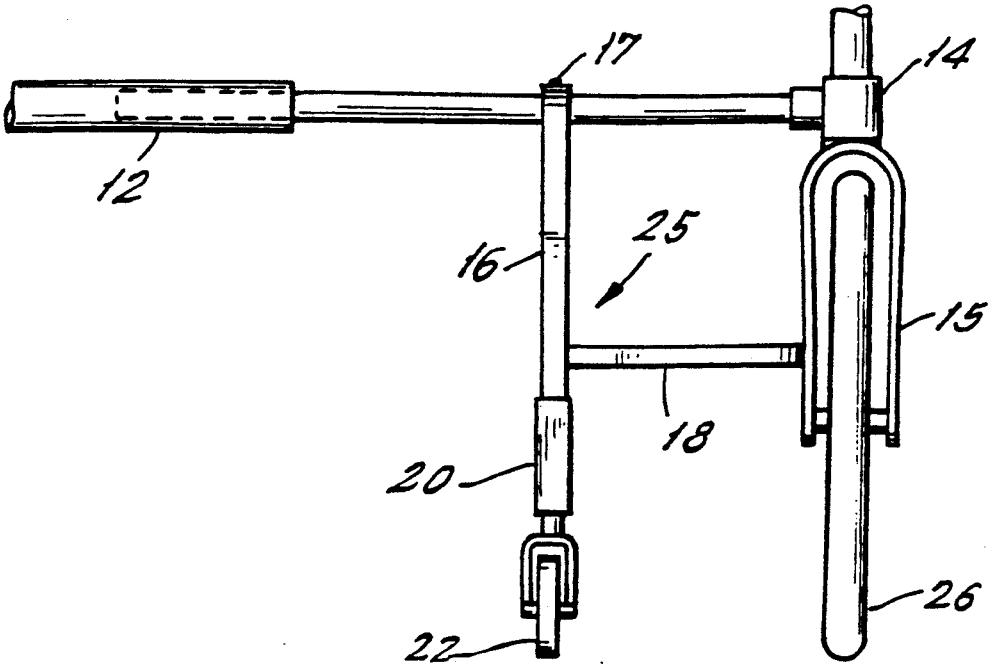
FIG. 5 is a fragmentary view of the braces and wheels of the device.

Referring now to FIGS. 5–7, the metal brace 16 is attached to the board 20 on one side of the extension pole 12. It then passes over the extension pole 12 and is preferably attached thereto by a bolt or screw 17. The other end of the brace 16 is attached to board 20 on the other side of the extension pole 12. The swivel wheels 22 and 24 are attached to the underside of board 20 by any convenient means, as best seen in FIG. 2.

The metal brace 16 is attached to carriage 4 by metal brace 18. The two ends of brace 18 are attached to the opposite sides of brace 16. Near its middle, the brace 18 is attached to the carriage 14, or more specifically, in this embodiment, to one side of the fork 15. Brace 16, brace 18, pole 12 and board 20 may be interconnected by screws, bolts, or any other convenient means.

The outrigger 25 formed by the board 20, swivel wheels 22 and 24 and metal braces 16 and 18, when attached to pole 12, acts as a support for the carriage.

FIG. 1A is a detail view of a belt 50 that can be used with any of the disclosed embodiments, for example. Advantageously, the belt 50 is sized to permit the player to swivel 360° within the belt to give the player a realistic freedom of movement. Attached to the belt 50 is a loop 52 made of metal or another strong material, firmly anchored to the belt 50. A hook 54 is connected to the cord 32 as shown in FIG. 1B. Preferably the hook 54 defines a very small gap 56, comparable to the thickness of the loop 52, so the hook and loop can be engaged and disengaged easily, but the hook remains on the loop securely. It may be advantageous to include a conventional spring-loaded locking device to close the gap 56. The hook and loop arrangement just described permits the player to easily disengage from the apparatus when it is necessary to chase the ball or to take a follow-up shot close to the basket.

The invention can be used for training in other sports than basketball, for example hockey or football, possibly by minor modifications of some of the components.

Figure 8:
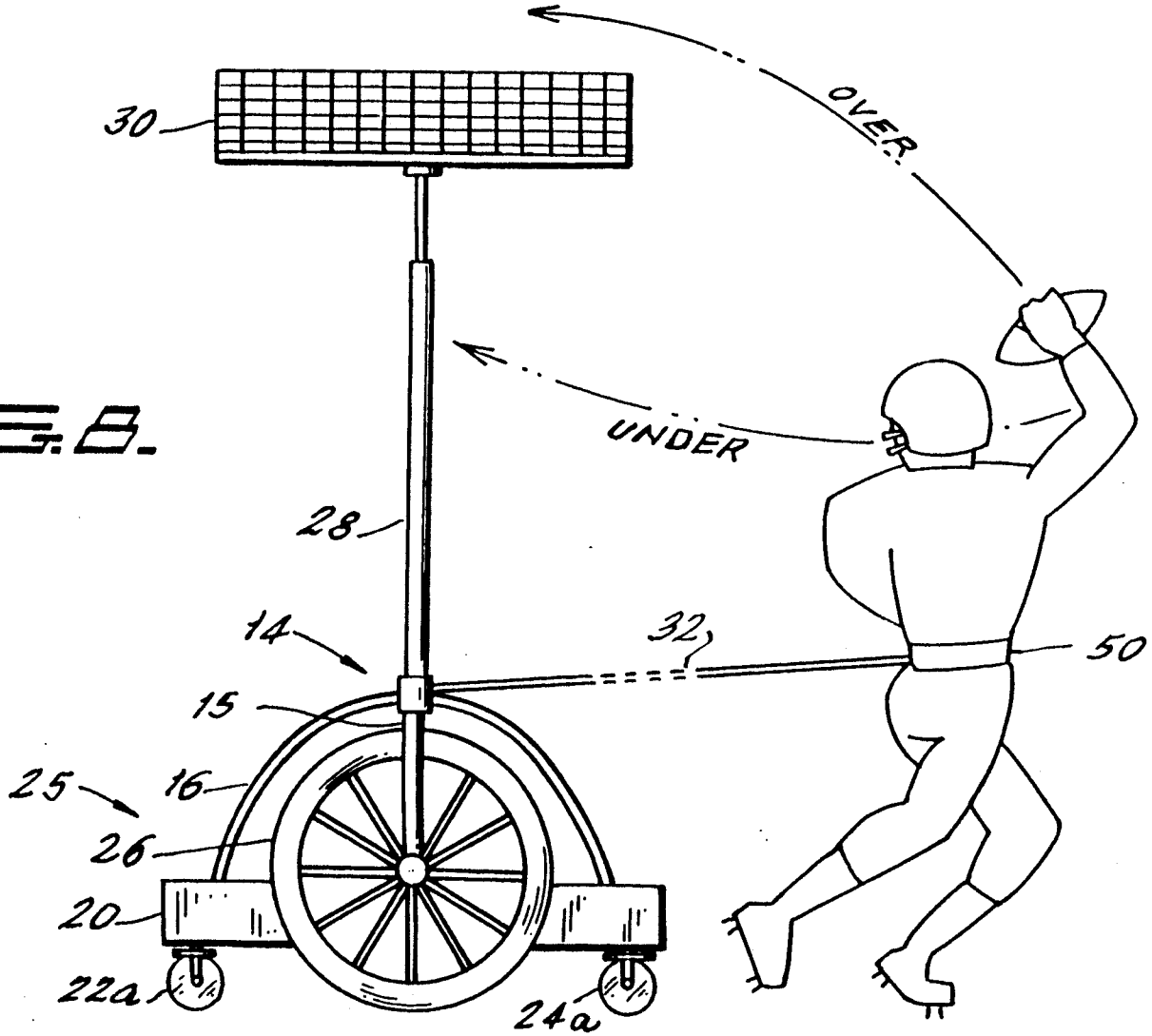
FIG. 8 is a perspective view of another embodiment of a device adapted for use in football training.

For example, FIG. 8 shows an embodiment of the training device for use in football training. As shown, it may be advantageous for the wheels **22*a* and 24*a* of the outrigger 25 to be larger than those shown in FIGS. 1–7, to accommodate them to the rougher surface commonly found on football playing fields. The invention is particularly useful in training football quarterbacks to move laterally, and simultaneously pass the football, in that the quarterback must clear the arms and bodies of defensive players and still pass accurately. As shown, the quarterback can be trained to pass either over or under the screen 30**.

Figure 9:
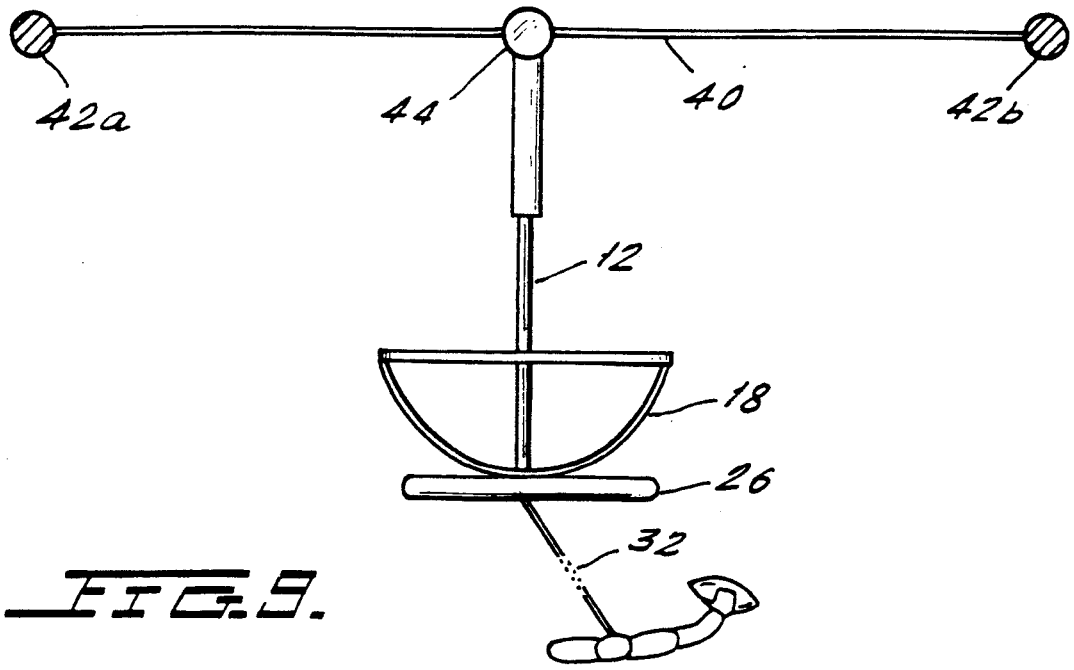
FIG. 9 is a plan view of the device of FIG. 8.

FIG. 9 shows another aspect of the embodiment of FIG. 8, which further adapts it for football training. As shown, the carriage is guided by a cable 40 which is connected tightly between a pair of stakes **42*a*, 42*b*, whereby the cable 40 extends across or substantially across a football field. A ring 44 on the pole 12 slides along the cable. The length of the cable can easily be adjusted by winding it around one or both of the stakes. This embodiment gives football quarterbacks practice in running the full width of the field, while being followed by the carriage holding the screen 30**.

Figure 10:
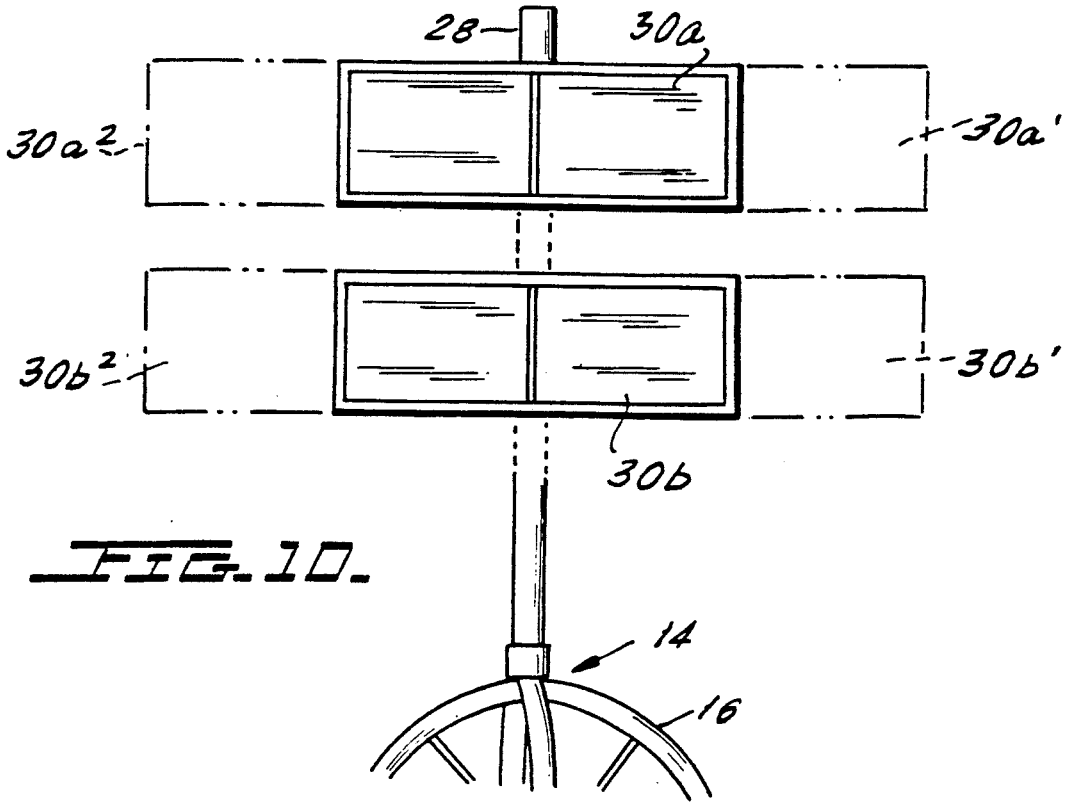
FIG. 10 shows an alternate embodiment comprising a pair of expandable screens mounted on one pole.

According to the alternate embodiment shown in FIG. 10, a pair of screens **30*a* and 30*b* can both be mounted on the pole 28. As shown in phantom, each of these screens can be extended by conventional means to also include areas 30*a*1, 30*a*2, 30*b*1, 30*b*2**. This embodiment of the screens is particularly useful for football, because it can be expanded in both the horizontal and vertical directions to adjust its blocking effect.

Figure 11:
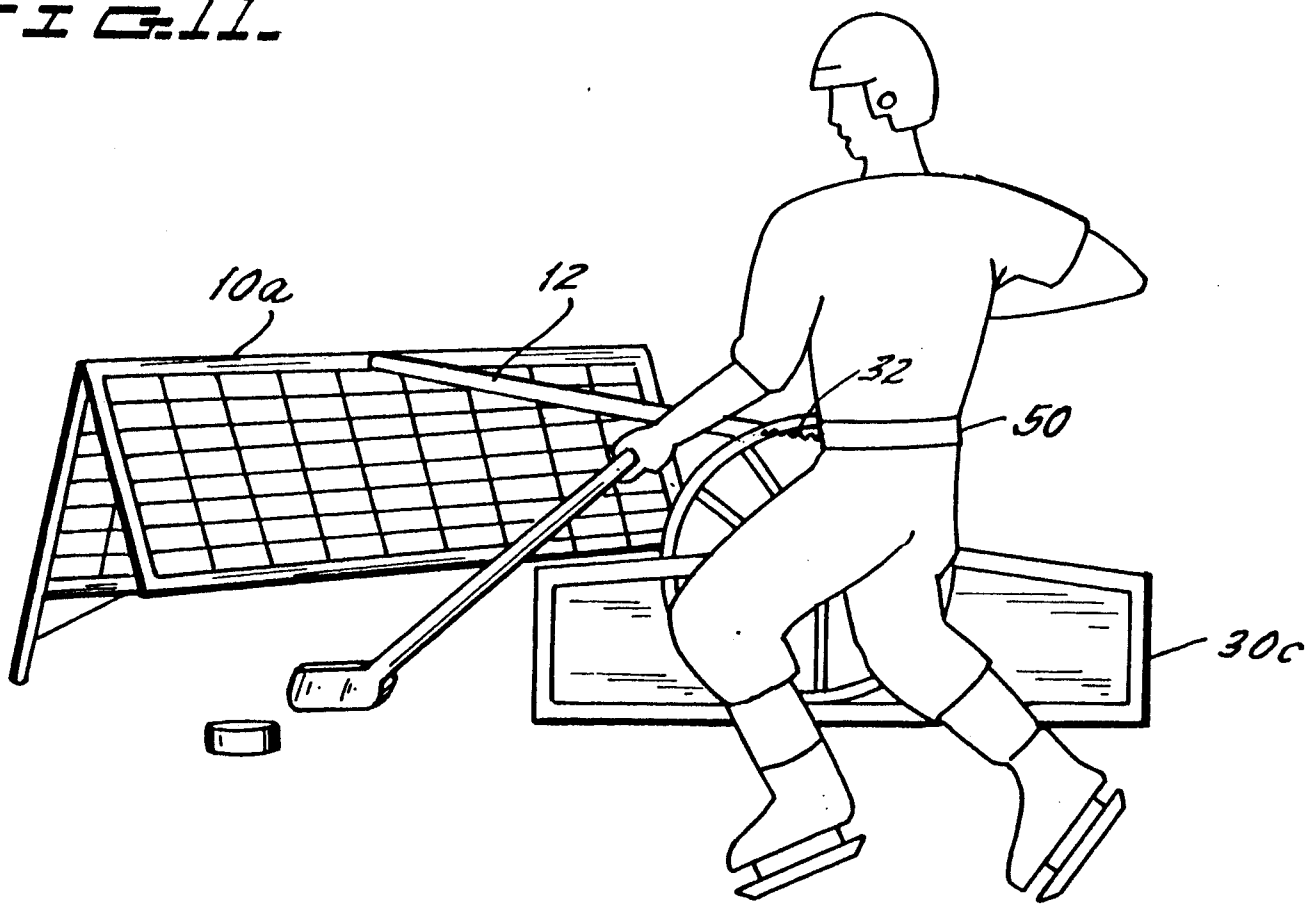

FIGS. 11 and 12 show an embodiment of the invention adapted for hockey training. In this embodiment, the screen **30*c* is attached to the wheel 26 and/or the carriage 14 by conventional means. The screen 30*c* is held on or close to the ice. The pole 12 is attached to the hockey goal 10*a* by a cable or the like 40*a* which extends across the goal 10***a*. A ring 44*a* on the pole 12 is slidable along the cable 40*a*.

Advantageously, the cord 32 is attached to the belt 50 shown in FIGS. 1A and 1B, the belt being sized loosely around the waist of the player, to give the player the ability to swivel 360° in any direction. This feature is also advantageous in the basketball and football embodiment discussed above.

Although the present invention has been described in relation to a particular embodiment thereof, many other variations and modifications and other uses will become apparent to those skilled in the art. Various sizes, shapes and materials detailed in this specification are not necessary to the invention. It is preferred, therefore, that the present invention be limited not by the specific disclosure herein, but only by the appended claims.

What is claimed is:

1. A basketball training device comprising a mobile carriage; blocking means on the carriage located for blocking a player's basketball shots; means for attaching said carriage to a location associated with the target of the player's basketball shots; and means for attaching said carriage to a player so that when the player moves laterally, said device follows the player and tends to block the player's shots.

2. A device as in claim 1, wherein said means for attaching said carriage to said location comprises a substantially rigid pole.

3. A device as in claim 2, wherein said pole is adjustable in length.

4. A device as in claim 2, further comprising an outrigger including rolling support means for further supporting said blocking means near said carriage.

5. A device as in claim 1, wherein said means for attaching said carriage to a player comprises a cord.

6. A device as in claim 5, wherein said cord is elastic.

7. A device as in claim 1, wherein said target is supported on a support pole, and further comprising means for preventing said carriage from moving behind said support pole.

8. A device as in claim 1, wherein said blocking means comprises a screen.

9. A device as in claim 8, wherein said screen is supported on said carriage by a pole which is adjustable in height.

10. A device as in claim 9, wherein said screen can be supported at approximately 3–10 feet from a floor on which said carriage rests.

11. A device as in claim 1, wherein said blocking means is adjustably supported on said carriage for being disposed at any height up to 10 feet from a floor on which said carriage rests.

12. A device as in claim 1, wherein said carriage is movable about said location in a semicircular path.

13. An athletic training device for training a player to move a projectile from near the player to a target, comprising:

blocking means capable of blocking said projectile; and locating means for continuously locating said blocking means at a location along a direct path between a present position of said player and said target, to continuously force said player to avoid said blocking means while moving sid projectile toward the target.

14. A device as in claim 13, wherein said locating means includes means for attaching the blocking means to said player and to a location associated with said target.

15. A device as in claim 13, wherein said target is a basketball hoop and said locating means is capable of continuously locating sid blocking means at locations between said player and said hoop as said player moves over substantially a 180° radius around said hoop.

16. A device as in claim 15, wherein sid locating means includes means for attaching the blocking means to said player and to a location associated with said target.

* * * * *